US006095886A

United States Patent [19]

Beckman et al.

[11] Patent Number: 6,095,886

[45] Date of Patent: Aug. 1, 2000

[54] TOY NURSING BOTTLE

[75] Inventors: Ralph Beckman, Providence; John Murphy, N. Scituate, both of R.I.; Roseanne Radosevich, New Bedford, Mass.; Stephanie Janis, New York, N.Y.

[73] Assignee: Design Lab, LLC, Providence, R.I.

[21] Appl. No.: 09/399,011

[22] Filed: Sep. 21, 1999

[51] Int. Cl.[7] ..... A63H 3/52

[52] U.S. Cl. ..... 446/267; 446/197; 446/180; 446/304

[58] Field of Search ..... 446/180, 197, 446/304, 267

[56] References Cited

U.S. PATENT DOCUMENTS

| | | | |
|---|---|---|---|
| 4,032,141 | 6/1977 | Tanimura | 273/1 |
| 4,923,429 | 5/1990 | Lewis | 446/197 |
| 4,990,118 | 2/1991 | Shiina | 446/197 |
| 4,990,119 | 2/1991 | Amici et al. | 446/267 |
| 4,995,844 | 2/1991 | McNett et al. | 446/21 |
| 5,017,171 | 5/1991 | Shiina | 446/197 |

*Primary Examiner*—Robert A. Hafer
*Assistant Examiner*—Urszula M. Cegielnik
*Attorney, Agent, or Firm*—Barlow, Josephs & Holmes, Ltd.

[57] ABSTRACT

A toy nursing bottle for use with a doll is provided with a reciprocating nipple that actuates a bellows to create air bubbles in a liquid within the bottle. The toy nursing bottle includes a transparent bottle having a body portion and a neck portion, and a volume of liquid, preferably a colored liquid, in the body portion of the bottle. A resiliently compressible bellows is supported within the neck portion of the bottle. The bellows includes an outlet valve in the bottom wall for injecting air bubbles into the liquid in the bottle when the bottle is inverted and the bellows is compressed, and an inlet valve in the bottom wall for drawing air back into the bellows when the bellows is released. An elongated air inlet tube is connected to the inlet valve and extends upwardly into an air space above the volume of liquid in the bottle so that the air is drawn into the bellows from the air space. A nipple shaped actuator mounted within a cap received on the neck of the bottle has an inner end in engagement with a top wall of the bellows and an outer end extending through the cap for engagement with the mouth of a toy doll. The actuator is reciprocatable axially inwardly for compressing the bellows and injecting air into the liquid within the bottle.

10 Claims, 5 Drawing Sheets

TOY NURSING BOTTLE

BACKGROUND OF THE INVENTION

The present invention relates generally to toys, and more particularly to a toy nursing bottle for use with a doll. The toy includes a nipple actuator which creates air bubbles in a liquid within the bottle to simulate the natural bubble action associated with a baby drinking a bottle of formula or milk.

Toy nursing bottles which simulate the draining of liquid from a bottle responsive to tipping of the bottle, and/or the formation of bubbles within a liquid in a bottle responsive to reciprocation of a nipple actuator have both heretofore been known in the art. In this regard, the U.S. Pat. No. to Amici et al No. 4,990,119 represents the closest prior art to the subject invention of which the applicant is aware. The Amici patent discloses a simulated baby nursing bottle having spaced inner and outer cylindrical shells providing a narrow annular cavity therebetween in which is disposed a colored liquid. The cap provides a concealed chamber into which the liquid may drain when the bottle is tipped downwardly. The simulated nipple includes an axially reciprocatable portion which acts upon a compressible bellows communicating with a clear liquid within the inner shell to produce air bubbles and agitation of the liquid within the container when the reciprocatable portion is depressed. A second compressible bellows is provided in the bottom of the inner shell which is vented to atmosphere and which is compressed to expel air therefrom when the first compressible member is compressed by the nipple portion.

Additionally, other amusement toys which utilize a reciprocating bellows to direct air bubbles into a liquid for movement of objects in the liquid have also been known in the art. In this regard, the U.S. Pat. Nos. to Lewis No. 4,923,429 and Shiina No. 4,990,118 are representative of such devices. The Lewis patent and the Shiina patent each disclose a bubblepropelled amusement device in which the play pieces are dispersed in a water bath contained in an enclosed transparent tank having an air nozzle in the bottom wall and an air space above the water bath. A pump assembly includes a bellows, an air inlet and an air outlet, both including a valve. The bellows outlet is coupled to the air nozzle so that when the bellows is compressed air is injected into the water bath through the nozzle. When the bellows is released, air is drawn back into the bellows from the air space above the water bath.

While the above-noted devices are functional for their intended purpose, there is always a continuing consumer and industry desire for new and improved toys which are more easily constructed, and which provide improved functionality at a reduced cost.

The present invention provides a toy nursing bottle including a reciprocating nipple that actuates a bellows to create air bubbles in a liquid within the bottle. The air bubbles simulate the natural bubble action associated with a baby drinking a bottle. The toy nursing bottle includes a transparent bottle having a body portion and a neck portion, and a volume of liquid, preferably a colored liquid, in the body portion of the bottle. A resiliently compressible bellows assembly is supported within the neck portion of the bottle. In this regard, the bellows assembly includes a normally closed outlet valve disposed in the bottom wall of the bellows for injecting air bubbles into the liquid in the bottle when the bottle is inverted and the bellows is compressed, and a normally closed inlet valve also disposed in the bottom wall of the bellows for drawing air back into the bellows when the bellows is released. The bellows assembly further includes an elongated air inlet tube having a first end connected to the inlet valve and a second end which extends upwardly into an air space above the volume of liquid in the bottle. The inlet tube allows the bellows to draw air inwardly from the air space above the liquid. A cap is threadably received on the neck portion of the bottle to capture and hold the bellows assembly within the neck portion of the bottle. A nipple shaped actuator element is mounted within the bellows assembly for actuation of the bellows. The actuator element has an inner end in engagement with a top wall of the bellows and an outer end extending through a cover member for engagement with the mouth of a toy doll. The actuator element is reciprocatable axially inwardly relative to the cover member for reciprocating compression of the bellows and resulting injection of air into the liquid within the bottle.

Accordingly, among the objects of the present invention are: the provision of a toy nursing bottle including a nipple actuator which creates air bubbles in a liquid within the bottle to simulate the natural bubble action associated with a baby drinking a bottle; the provision of such a toy nursing bottle wherein the bellows assembly is housed within a neck portion of the bottle; the provision of such a toy nursing bottle having a compact and simple construction; the provision of such a toy nursing bottle wherein the air inlet and outlet are provided with check valves to restrict the flow of air and liquid through the bellows; and the provision of such a toy nursing bottle wherein the air inlet valve is provided with an elongated air inlet tube to draw air in from an air space above the liquid in the bottle.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE PREFERRED EMBODIMENT

Figure 1:
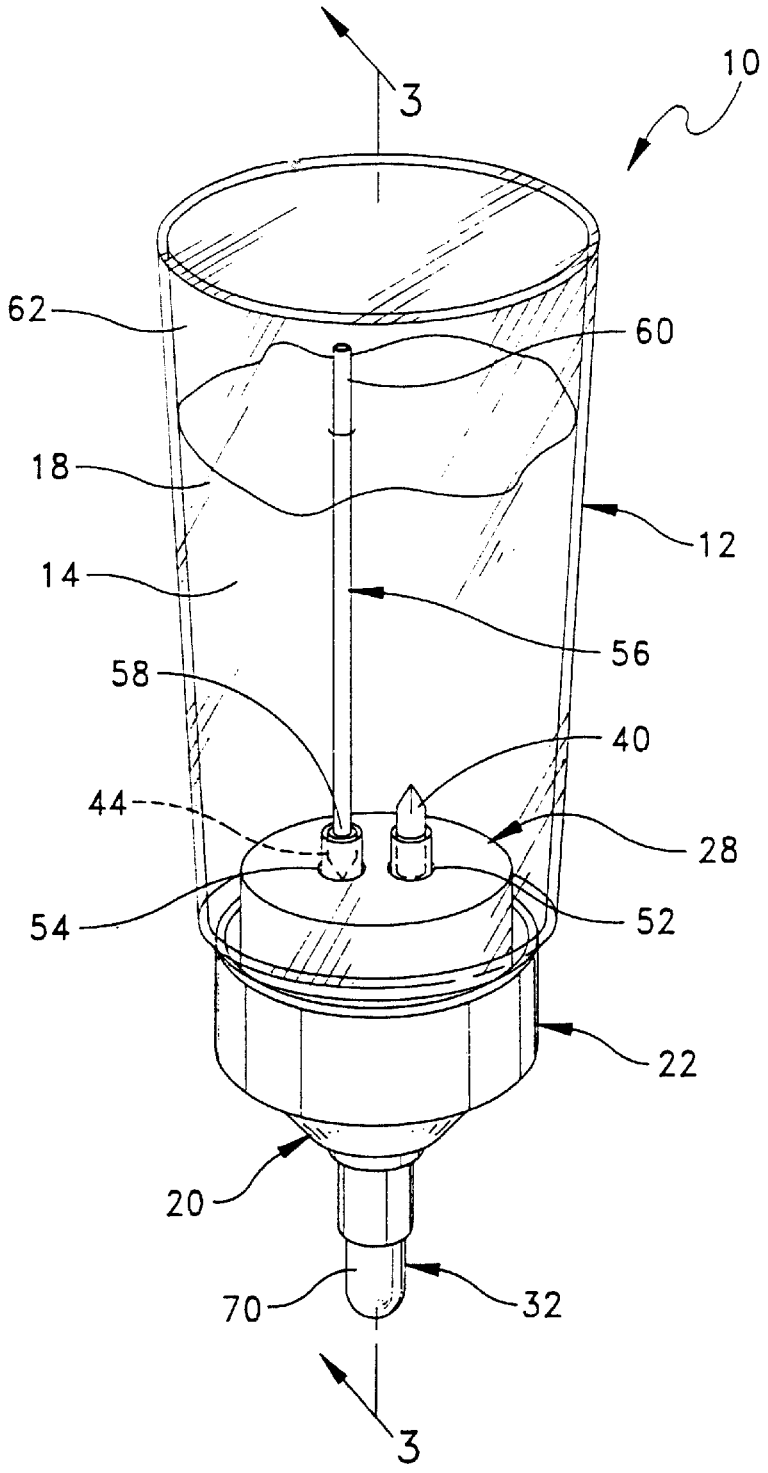
FIG. 1 is a perspective view of the toy nursing bottle of the present invention.
Figure 2:
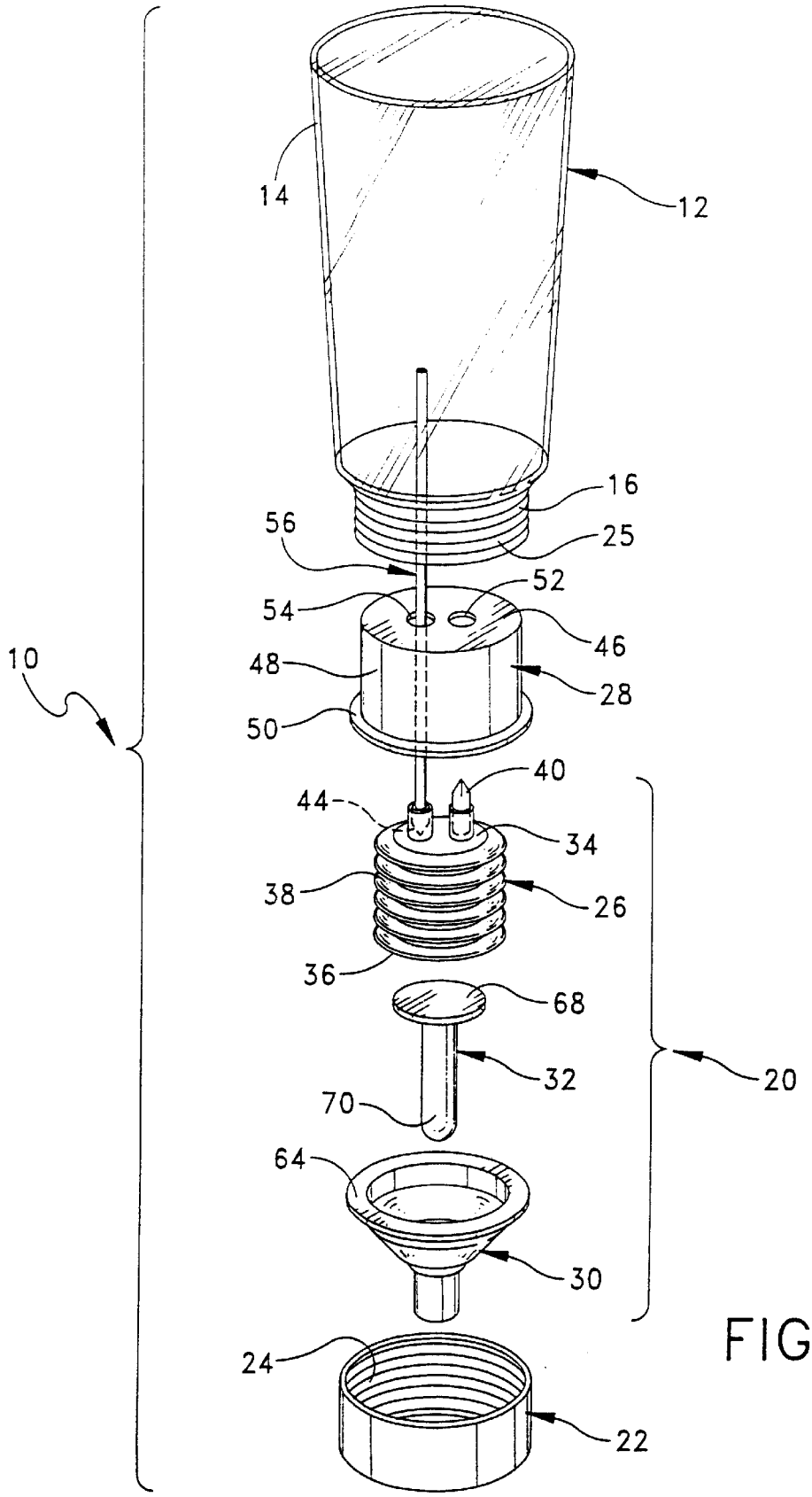
FIG. 2 is an exploded perspective view thereof.
Figure 3:
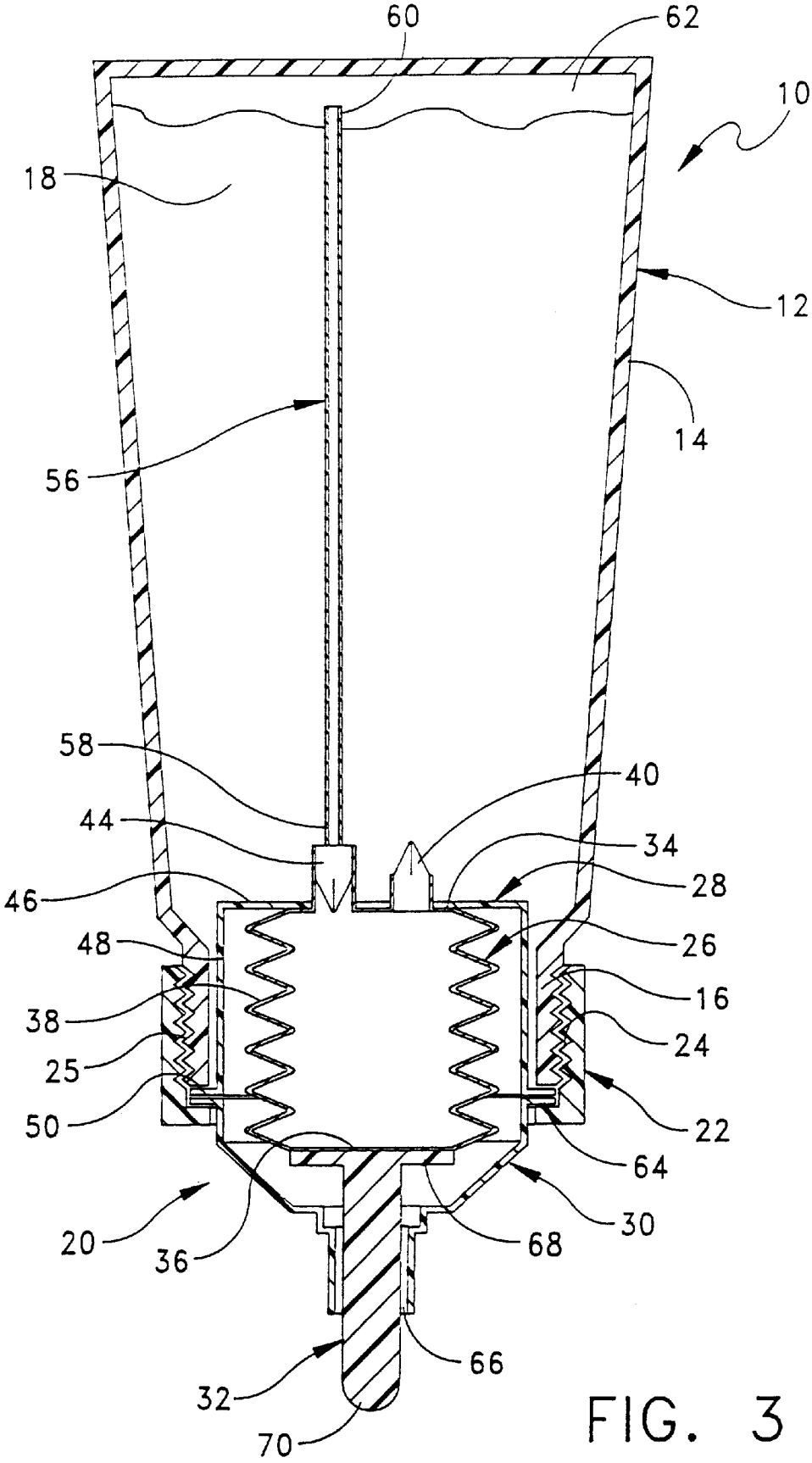
FIG. 3 is a cross-sectional view thereof taken along line 3—3 of FIG. 1.

Referring now to the drawings, the toy nursing bottle of the instant invention is illustrated and generally indicated at 10 in FIGS. 1–5. As will hereinafter be more fully described, the instant toy nursing bottle 10 utilizes a reciprocating nipple actuator to create air bubbles in a liquid within the bottle to simulate the natural bubble action associated with a baby drinking and draining a bottle of formula or milk.

Unless otherwise indicated, it is to be understood that all of the constituent parts of the present toy are preferably molded from a suitable plastic material. However, certain parts may also be fabricated from other materials.

The toy nursing bottle 10 comprises a transparent bottle generally indicated at 12 having a body portion 14 and a neck portion 16, a volume of liquid 18, preferably a colored liquid, contained within the body portion 14 of the bottle 12, a bellows assembly generally indicated at 20 supported within the neck portion 16 of the bottle 12, and an annular cap generally indicated at 22.

The bottle 12 is preferably molded from a transparent plastic wherein the body portion 14 is formed in a generally cylindrical shape, or other desired shape, simulating an actual nursing bottle. The neck portion 16 of the bottle is preferably cylindrical so as to provide an outer threaded surface 24 for threaded engagement with a threaded interior surface 26 of the cap 22. Alternatively, the neck 16 and cap 22 could be formed in another noncylindrical shape. However, in this case, the cap 22 would need to be secured to the neck portion 16 of the bottle 12 by an adhesive or other securing means.

The bellows assembly 20 comprises a resilient bellows member generally indicated at 26, a retaining cup generally indicated at 28, a nipple shaped cover member generally indicated at 30, and a nipple shaped actuator element generally indicated at 32. The resilient bellows member 26 is preferably molded from a resilient plastic in a conventional accordion configuration having a bottom wall 34, top wall 36 and pleated side walls 38. The bottom wall of the bellows member includes a normally closed outlet valve 40 for injecting air bubbles 42 into the liquid 18 in the bottle when the bellows 26 is compressed, and a normally closed inlet valve 44 for drawing air back into the bellows 26 when the bellows is released. The inlet and outlet valves 40,44 each preferably comprise resilient duckbill check valves which are substantially water and air tight under low pressure conditions as found within the present application.

The retaining cup 28 includes a bottom wall 46, side wall 48 and a lip flange 50. The retaining cup 28 is configured and arranged so as to be seated within the neck portion 16 of the bottle 12 with the lip flange 50 resting on the edge of the neck portion of the bottle. The bellows 26 is seated within the retaining cup 28 with the bottom wall 34 in resting engagement with the bottom wall 46 of the retaining cup 28. The two valves 40,44 extend through respective openings 52,54 formed in the bottom wall 46 of the retaining cup 28.

The bellows assembly 20 further includes an elongated air inlet tube generally indicated at 56 having a first end 58 connected to the inlet valve 44 and a second end 60 which extends upwardly into an air space 62 formed above the volume of liquid 18 in the bottle 12 when the bottle 12 is tilted downwardly as shown in FIGS. 1–5. The inlet tube 56 allows the bellows 26 to draw air inwardly from the air space 62 above the liquid 18.

The cover member 30 is molded generally in the shape of a frusto-conical nipple. The base end of the cover member 30 is provided with a seating flange 64 which is received in mating engagement with the upper surface of the lip flange 50 of the retaining cup 28, thereby capturing the bellows 26 therebetween. The upper end of the cover member 30 is provided with an axial opening 66 in which the nipple shaped actuator element 32 is mounted. The actuator element 32 has an inner end 68 in which engages with the top wall 36 of the bellows 26 and an outer end 70 extending through the axial opening 66 of the cover member 30 for engagement with the mouth of a toy doll (not shown). The actuator element 32 is reciprocatable axially inwardly relative to the cover member 30 for reciprocating compression of the bellows 26 and resulting injection of air bubbles 42 into the liquid 18 within the bottle.

The cap 22 is annular in configuration having an inwardly threaded inner surface 24 which is threadably received on the outwardly threaded surface 25 of the neck portion 16 of the bottle 12 over the cover member 30 to capture and hold the entire bellows assembly 20 within the neck portion 16 of the bottle 12.

Figure 4:
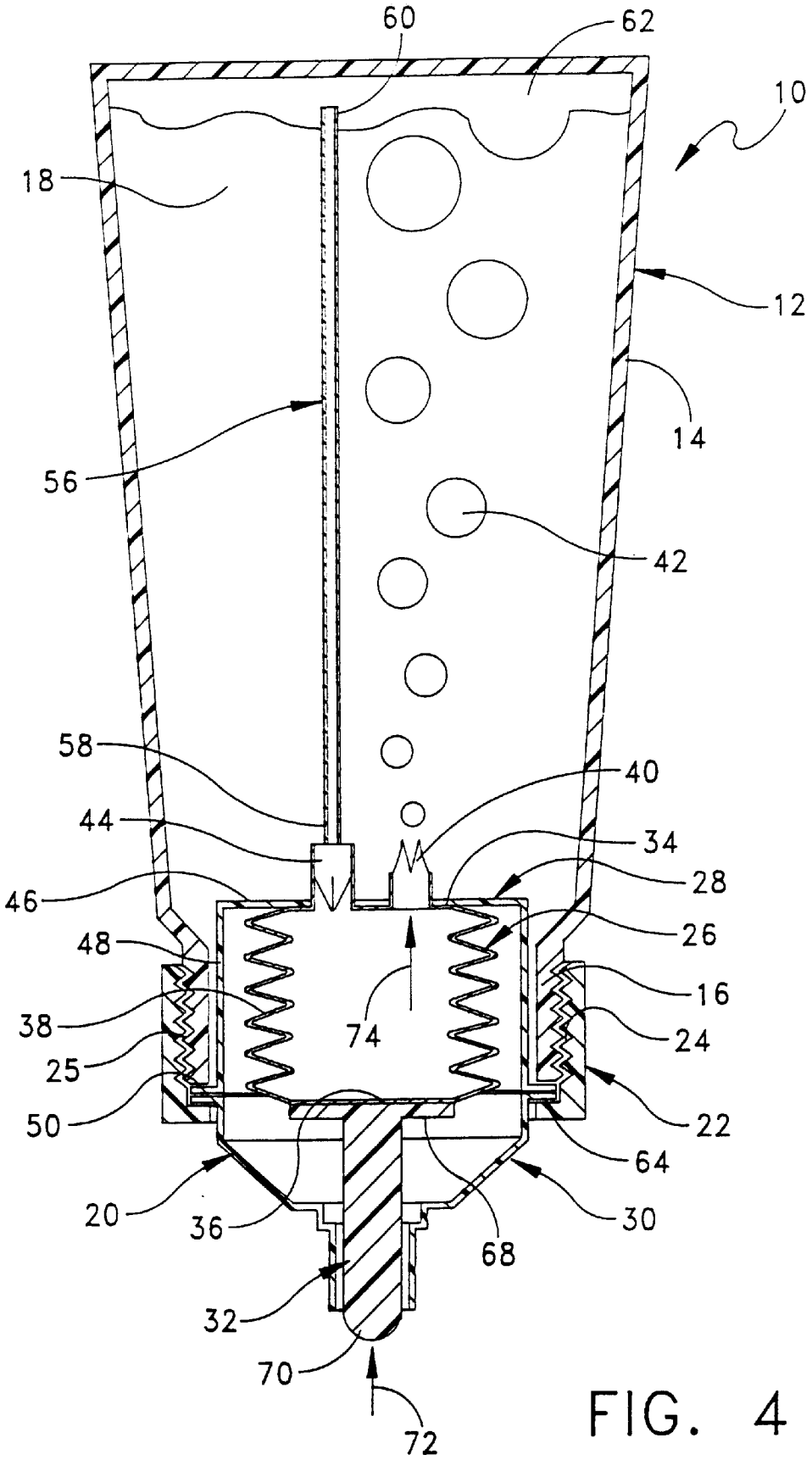
FIG. 4 is another cross-sectional view thereof showing inward movement of the nipple actuator and creation of air bubbles in the liquid.
Figure 5:
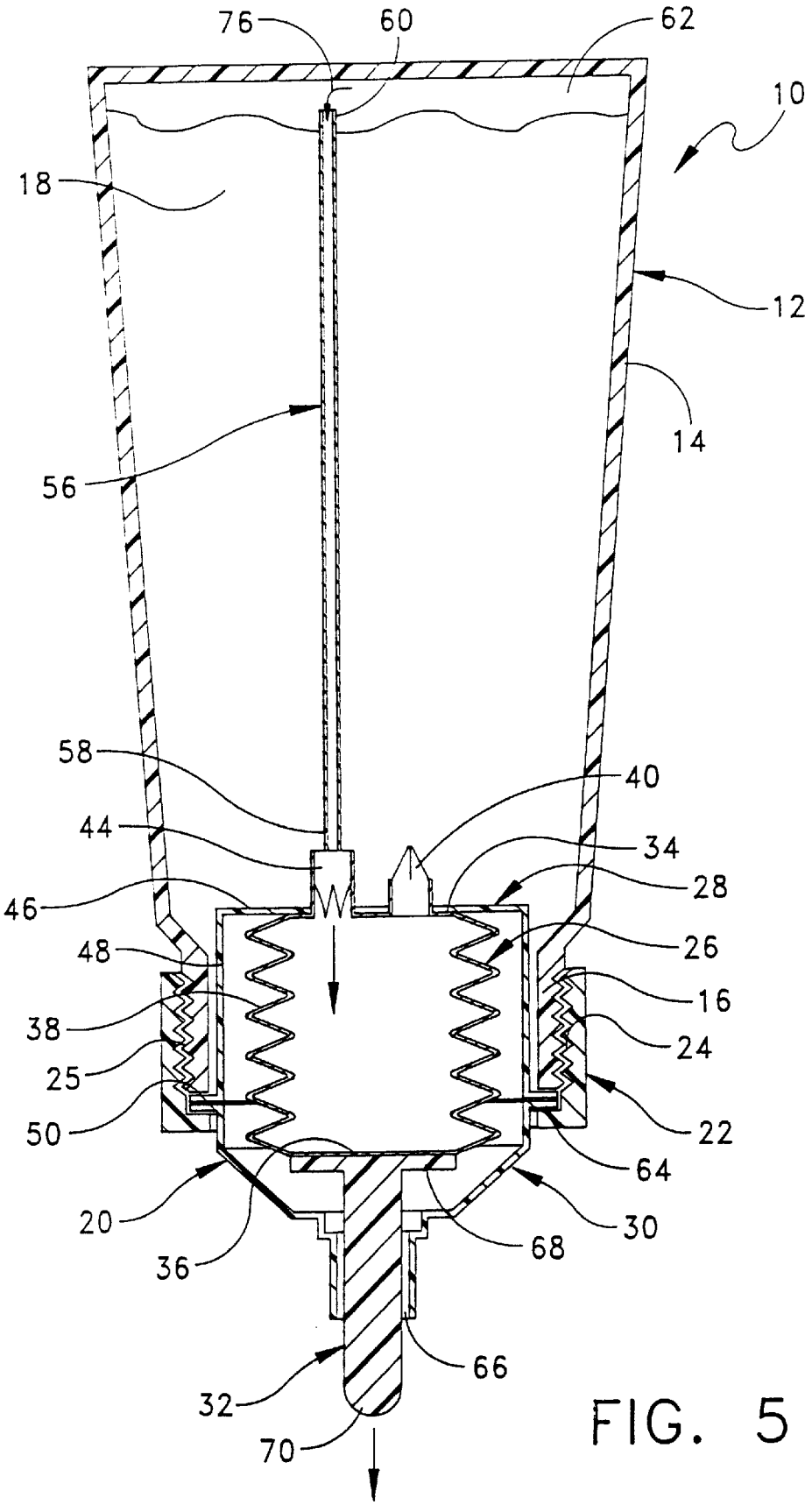
FIG. 5 is yet another cross-sectional view thereof showing release of the bellows and the return of air into the bellows from the air space above the liquid.

Referring to FIGS. 4 and 5 for operation of the bottle 10, the actuator element 32 is pressed inwardly (see arrow 72) by engagement with the mouth of a doll (not shown). The actuator element 32 moves axially inwardly relative to the cover member 30 and compresses the bellows 26. Air (arrow 74) from within the bellows 26 is injected into the bottle 12 through the outlet valve 40 forming bubbles 42 in the liquid 18 therein. The bubbles 42 rise to the air space 62 above the liquid 18. When the bellows is released (FIG. 5), a vacuum is created within the bellows 26 opening the inlet valve 44, and drawing air (arrow 76) back into the bellows 26 from the air space 62 above the liquid 18 through inlet tube 56.

It can therefore be seen that the present invention provides a simple, yet effective construction for creating bubbles in a toy nursing bottle. The simple bellows construction mounted directly within the neck portion of the bottle provides the same functionality as many of the prior art devices without the added complexity and number of molded parts. Because of the simplicity, the toy can be fabricated from a fewer number of parts leading to a reduced cost and reduced end consumer price point. Positioning of the check valves directly within the body of the bellows further simplifies construction and assembly of the toy. It is believed that the use of colored liquids, and in particular opaque liquids, such as white (simulating milk), will effectively hide the air inlet tube and the check valves which would normally be visible through the transparent body of the bottle. However, it is to be understood that the use of a colored liquid is not critical to the functionality of the bellows assembly or the toy in general. For these reasons, the instant invention is believed to represent a significant advancement in the art which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A toy nursing bottle comprising:

a bottle having a body portion and a neck portion;

a volume of liquid in the body portion of said bottle;

a resiliently compressible bellows mounted within the neck portion of the bottle, said bellows having a bottom wall facing an interior portion of said bottle, and a top wall facing upwardly;

a normally closed outlet valve disposed in the bottom wall of the bellows, said outlet valve injecting air bubbles into the volume of liquid in the bottle when the bottle is inverted and the bellows is compressed;

a normally closed inlet valve disposed in the bottom wall of the bellows for drawing air back into the bellows when the bellows is released;

an air inlet tube having a first end connected to said inlet valve and a second end which extends upwardly into an air space above the volume of liquid in the bottle when the bottle is inverted; and an actuator in engagement with the upper wall of said bellows, said actuator engaging and compressing said bellows upon movement thereof.

2. The toy nursing bottle of claim 1 wherein said inlet valve and said outlet valve comprise duckbill check valves.

3. The toy nursing bottle of claim 1 further comprising a nipple shaped cover seated on the neck portion of the bottle, said actuator extending through said cover and being reciprocatable axially relative to the cover.

4. A toy nursing bottle comprising:

a bottle having a body portion and a neck portion;

a volume of liquid in the body portion of said bottle;

a resiliently compressible bellows supported within the neck portion of the bottle, said bellows having a bottom wall facing an interior portion of said bottle, and a top wall facing upwardly;

a normally closed outlet valve disposed in the bottom wall of the bellows, said outlet valve injecting air bubbles into the volume of liquid in the bottle when said bottle is inverted and said bellows is compressed;

a normally closed inlet valve disposed in the bottom wall of the bellows for drawing air back into the bellows when the released;

an air inlet tube having a first end connected to said inlet valve and a second end which extends upwardly into an air space above the volume of liquid in the bottle when the bottle is inverted;

a cap mounted on the neck portion of the bottle; and an actuator mounted within the cap, said actuator having an inner end in engagement with the top wall and an outer end extending through the cap for engagement with the mouth of a toy doll, said actuator being reciprocatable axially inwardly relative to the cap for reciprocating compression of the bellows.

5. The toy nursing bottle of claim 4 wherein said inlet valve and said outlet valve comprise duckbill check valves.

6. The toy nursing bottle of claim 4 wherein said bellows is supported within a retaining cup seated within the neck portion of the bottle, said inlet valve and said outlet valve extending through respective openings in a bottom wall of the retaining cup.

7. The toy nursing bottle of claim 5 wherein said bellows is supported within a retaining cup seated within the neck portion of the bottle, said inlet valve and said outlet valve extending through respective openings in a bottom wall of the retaining cup.

8. The toy nursing bottle of claim 4 further comprising a nipple shaped cover seated on the neck portion of the bottle, said cover being captured between the neck portion of the bottle and the cap, said actuator extending through said cover and being reciprocatable axially relative to the cover.

9. The toy nursing bottle of claim 6 further comprising a nipple shaped cover seated on the neck portion of the bottle, said cover being captured between the neck portion of the bottle and the cap, said actuator extending through said cover and being reciprocatable axially relative to the cover.

10. A toy nursing bottle comprising:

a bottle having a body portion and a neck portion;

a volume of liquid in the body portion of said bottle;

a retaining cup seated within the neck portion of the bottle, said retaining cup having a bottom wall, a side wall and a seating flange extending outwardly from the side wall, said seating flange being seated on a rim of the neck portion a resiliently compressible bellows seated within said retaining cup, said bellows having a bottom wall in engagement with the bottom wall of the retaining cup, and a top wall facing upwardly;

a nipple shaped cover member seated on the neck portion of the bottle, said cover member having an axial opening and a seating flange which is assembled in mating relation with the seating flange of the retaining cup;

a normally closed air outlet valve disposed in the bottom wall of the bellows, said outlet valve extending through an opening in the bottom wall of the retaining cup, said outlet valve comprising a duckbill check valve, said outlet valve injecting air bubbles into the volume of liquid in the bottle when the bottle is inverted and the bellows is compressed;

a normally closed air inlet valve disposed in the bottom wall of the bellows for drawing air back into the bellows when the released, said inlet valve extending through an opening in the bottom wall of the retaining cup, said inlet valve comprising a duckbill check valve, an air inlet tube having a first end connected to said inlet valve and a second end which extends upwardly into an air space above the volume of liquid in the bottle when the bottle is inverted;

an annular cap threadably mounted on the neck portion of the bottle to capture and hold the retaining cup and cover member in engagement with the neck portion of the bottle; and an elongated actuator axially mounted within the cover member, said actuator having an inner end in engagement with the top wall of the bellows and an outer end extending outwardly of the cover member for engagement with the mouth of a toy doll, said actuator being reciprocatable axially inwardly relative to the cap for reciprocating compression of the bellows.

* * * * *